US006167604B1

(12) United States Patent
Del Bono

(10) Patent No.: US 6,167,604 B1
(45) Date of Patent: Jan. 2, 2001

(54) CURB VALVE REPLACEMENT AND INSTALLATION TOOL

(76) Inventor: Dennis E. Del Bono, 5035 Coldwater Canyon, #208, Sherman Oaks, CA (US) 91423

( * ) Notice: Under 35 U.S.C. 154(b), the term of this patent shall be extended for 0 days.

(21) Appl. No.: 09/420,145

(22) Filed: Oct. 18, 1999

(51) Int. Cl.[7] ..... B25B 27/14

(52) U.S. Cl. ..... 29/281.5; 29/237; 29/271; 29/272; 29/281.4; 29/281.5

(58) Field of Search ..... 29/281.5, 281.4, 29/271, 272, 237, 890.121; 285/23, 80; 269/43

(56) References Cited

U.S. PATENT DOCUMENTS

| | | | | |
|---|---|---|---|---|
| 2,105,954 | * | 11/1938 | Rippe | 29/272 |
| 3,352,147 | * | 11/1967 | Ligon | 29/281.5 |
| 3,394,389 | * | 7/1968 | Amir | 29/272 |
| 5,118,024 | * | 6/1992 | McClure | 29/272 |
| 5,373,617 | * | 12/1994 | Caley | 29/281.5 |

* cited by examiner

*Primary Examiner*—Robert C. Watson
(74) *Attorney, Agent, or Firm*—Albert O. Cota

(57) ABSTRACT

An installation tool for replacing inoperable residential city water service curb valves. The tool has a body (20), preferably formed of steel plate in channel shape with a first leg (22) and a second leg (24). A clearance notch (26) is located in the first leg and a ball and socket elbow mounting bracket (30) is attached on the inner surface surrounding the notch, and an alignment hole (28) is provided in the second leg. The bracket is formed in two half's having a upper clasp (32) and a lower clasp (34) with a hinge (44) pivotally holding them together. A draw pull latch (50) attaches the two half's concurrently, with the upper half permanently affixed to the body, thus completing the tools structure. In use an inoperable valve is removed and the replacement curb valve (54) is positioned between the legs of the body with a pipe nipple (56) disposed loosely through the clearance hole. The tool and valve are attached to an existing ball and socket elbow (42) around its hexagonal flats with the bracket locked in place with the latch. The replacement valve may then be easily screwed into the elbow, under water pressure, as it is held in place and aligned with the nipple which is rotatably retained in the alignment hole.

16 Claims, 2 Drawing Sheets

CURB VALVE REPLACEMENT AND INSTALLATION TOOL

TECHNICAL FIELD

The invention pertains to the general field of water valve servicing tools and more particularly to a curb valve replacement and installation tool that can be used while pressurized water is flowing through the valve.

BACKGROUND ART

One of the most common problems encountered by construction workers or engineers is when a curb valve or curb stop becomes inoperable or otherwise needs to be replaced or installed. Due to the manner in which these valves operate and the function for which they are designed, a certain amount of water pressure is constantly forced upon them. If this water pressure is too high for the valve to be replaced by hand, the water company employee(s) may be forced to shut down the water main, which typically provides water to a large number of residential and/or commercial customers. The duration for which these customers are without water can vary substantially, depending on how much work must be done and the difficulty involved. For most residential customers the lack of water is a mere inconvenience, but for others, especially larger, commercial customers, any time spent without water is a very significant problem and often can present a dangerous situation.

The only alternative to shutting off the water main is to dig down to the main and shut off what is known as the corporation valve. This second option is time-consuming and can be difficult to accomplish under certain conditions and is therefore not usually done.

Obviously, if there was some way of replacing or installing curb valves that are under pressure, without the need of relieving that pressure beforehand, it would be beneficial both to those who actually work on the valves and to those who are serviced by them.

A search of the prior art did not disclose any patents that read directly on the claims of the instant invention, however the following U.S. patents are considered related:

| PATENT NO. | INVENTOR | ISSUED |
|---|---|---|
| 4,630,347 | Chilton | Dec. 23, 1986. |
| 4,501,055 | George | Feb. 26, 1985. |
| 4,027,561 | Junkers | Jun. 7, 1977. |

The Chilton patent discloses a hydrant tool assembly for installing or removing a seat ring and valve from a hydrant shoe located beneath a hydrant. The tool includes a valve cap structure that mates with the valve and extends through a top portion of the hydrant. A hydraulic apparatus is provided that is attachable to the top portion of the hydrant for providing a torquing force to the valve cap structure. A lever structure also is provided that is attachable to the hydraulic structure for enabling leveraged manual turning of the valve cap structure to supplement the hydraulic torquing of the valve cap structure.

The George patent discloses a pipe tool having a collar or fitting containing a seal which is brought into engagement with the free end of a section or joint. The tool includes a first pipe-engaging member having a collar engageable about the pipe in abutment with a collar of a pipe section in place. A winch and cable are attachable to a second pipe tool engageable at the free end of the section or joint to be placed. Actuation of the winch will bring the section into sealing engagement with the collar. The yoke and collar of the second tool are also pivotable to provide an additional joining force. A bearing plate is securable at the collar of the second pipe engaging tool to abut the end of the pipe section and when removed permits the collar to engage the exterior of the pipe abutting a fitting on the pipe.

The Junkers patent discloses a hydraulically operated wrench for tightening and loosening threaded connectors. The wrench includes a shaft and a socket removably mounted on one end of the shaft for engaging a polygonal portion of a threaded connector. The shaft carries a ratchet wheel for rotation therewith which is operated by a ratchet pawl pivotally mounted intermediate the ends of a first lever, one end of which is pivotally mounted on the shaft. A second lever is pivotally mounted on one end on the shaft, whereas a cylinder-and-piston unit is pivotally connected at opposite ends to the other ends of the first and second lever so that during reciprocation of the piston in the cylinder the shaft and the socket are rotated to tighten or loosen the threaded connector engaged by the socket.

For background purposes and as indicative of the art to which the invention is related reference may be made to the remaining cited patents.

| PATENT NO. | INVENTOR | ISSUED |
|---|---|---|
| 5,332,044 | Dallas, et al | Jul. 26, 1994. |
| 4,830,121 | Krasnov, et al | May 16, 1989. |
| 4,095,324 | Lawson | Jun. 20, 1978. |
| 3,718,057 | Berchtold | Feb. 27, 1973. |

Joseph G. Pollard Company Inc. Catalog July 1999, page 78, Covering an "AQUA STOP CURB STOP REPLACEMENT TOOL"

DISCLOSURE OF THE INVENTION

When a residential or industrial city water service curb valve becomes inoperable, it may be necessary to replace the valve while the valve is under water pressure. While this task is not impossible it is very difficult in that the pressure of the water tends to impel the valve away from a ball and socket elbow. Considerable force must be exerted to overcome the inertia of the water and make the connection by precisely aligning and mating the valve threads. During this time an installer must continuously face a spray of water before the valve can be aligned and screwed in thus shutting off the pressurized flow. If the pressure is physically too high for the valve to be readily replaced by hand it may be required to shut down the water main completely, which greatly inconveniences all of the consumers serviced by that particular section of the main. An expensive alternative is to locate and dig down to the Utilities Corporation valve located at the main and shut off the individual water pressure to the residence.

To alleviate the above replacement and removal problems associated with the curb valve, which is also referred to as a curb stop, hereinafter "valve" the inventive valve tool is utilized. In its basic form, the valve tool is comprised of:

a) An inverted channel-shaped body with a downward depending first leg having a clearance notch therein and a downward depending second leg having an alignment hole therein, b) a ball and socket elbow mounting bracket having an upper clasp and a lower clasp with the upper clasp permanently affixed adjacent the first leg clearance notch, protruding outward toward the alignment hole, c) hinge means on the mounting bracket, pivotally connecting the bracket upper clasp to the bracket lower clasp, and d) latch means attached to the bracket lower clasp interfacing with the bracket upper clasp such that when the tool is positioned upon the hexagonal flats of a ball and socket elbow and the bracket lower clasp is pivoted into contact with the upper clasp the tool is locked in place. The latch means, thus permits an opened replacement curb valve that has been connected to a pipe nipple loosely disposed within the alignment hole to be manually threaded into an existing ball and socket elbow while water is flowing under pressure from a water main.

In view of the above disclosure, it is the primary object of the invention to permit a residential or industrial curve valve to be replaced under any and all high pressure situations by the use of the inventive tool which permits the valve to be removed normally and a replacement valve substituted without shutting down the water pressure. This is accomplished by attaching the tool to the ball and socket elbow of the valve using a convenient draw pull latch, thus enclosing a hexagonal shoulder on the elbow. In preparation for use, a new valve is positioned within the tool and a pipe nipple is inserted into the valve on one end through an alignment hole. This arrangement allows the valve to be free to rotate and align with the threads in the ball and socket elbow. While the water is unavoidably flowing under pressure, the damaged valve is then removed. The tool which includes a channel shaped body, protects the worker from the inevitable spray and the new valve may be easily mated with the elbow and screwed in place, as it is in direct alignment and in close proximity to the elbow and is held captive by the tool. It may be seen that the new valve is held in place between the sturdy pair of downward depending legs of the channel shaped body, and the ball and socket elbow is secured by the mounting bracket clasps, therefore the water cannot force the valve out of position once the tool is in place.

An important object of the invention is that the tool is simple and cost effective as it only consists of a channel shaped body of steel plate uncomplicated in construction with a bracket having a hinged portion attached on an inside surface.

Another object of the invention is the simplicity of use, as one skilled in the art may readily understand its function and since the valve alignment is almost guaranteed, the operation of the tool is quick and easily accomplished.

Still another object of the invention is that the tool will fit almost any combination of ball and socket elbow and curb valve. To make the tool universal, a spacer may be furnished that is placed between the valve and the second downward-depending leg of the tool's body, thus making up for a short valve or ball and socket elbow.

These and other objects and advantages of the present invention will become apparent from the subsequent detailed description of the preferred embodiment and the appended claims taken in conjunction with the accompanying drawings.

BEST MODE FOR CARRYING OUT THE INVENTION

Figure 2:
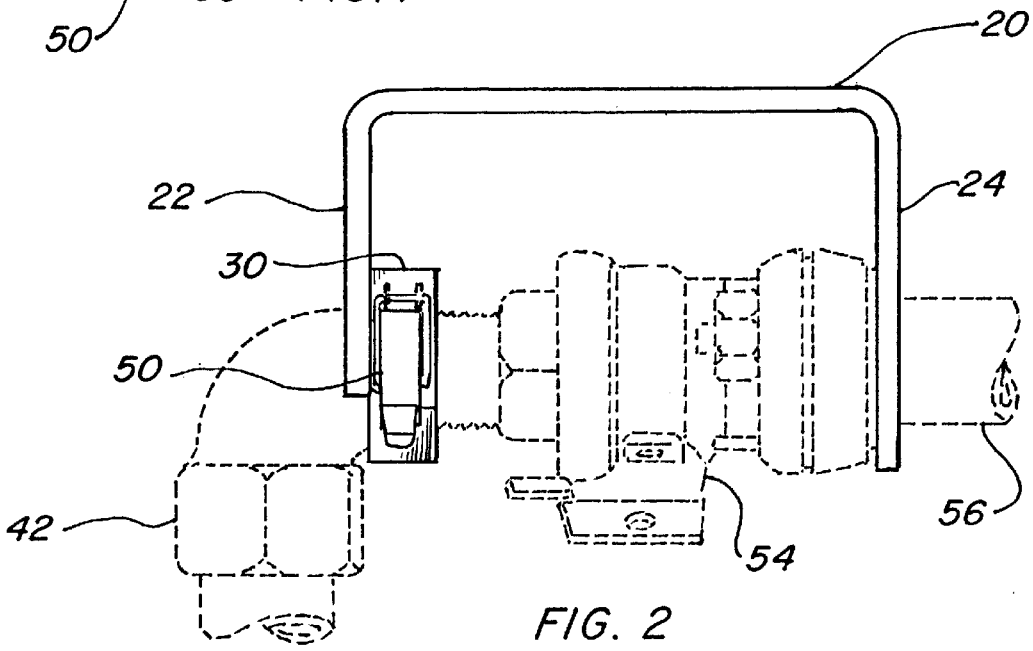
FIG. 2 is a side view of the preferred embodiment clamped onto a ball and socket elbow with a replacement curb valve held in place by a pipe nipple with the elbow and valve shown with broken lines.
Figure 3:
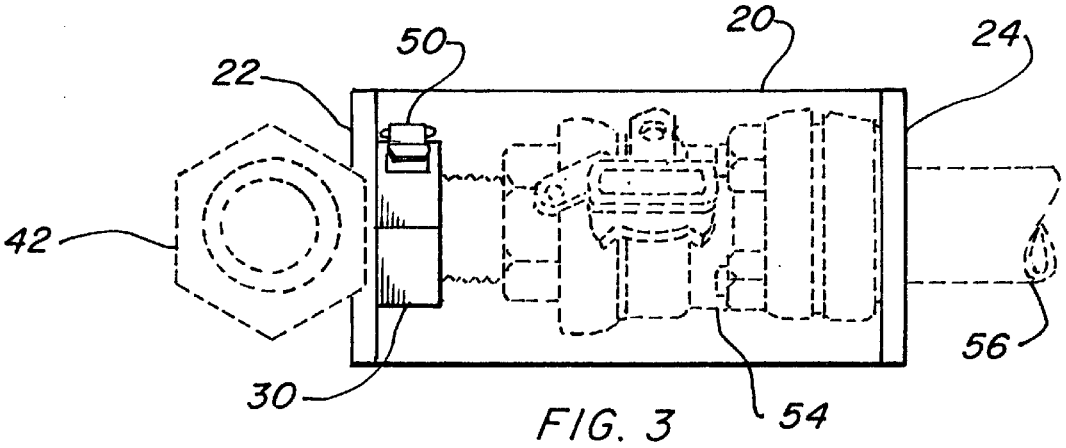
FIG. 3 is a bottom view of the preferred embodiment clamped onto a ball and socket elbow with a replacement curb valve held in place by a pipe nipple with the elbow and valve shown with broken lines.
Figure 4:
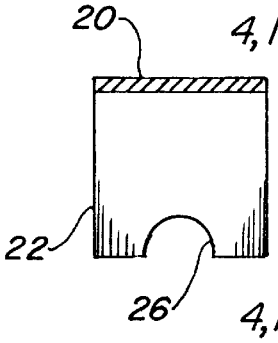
FIG. 4 is a cross-sectional view taken along lines 4—4 of FIG. 5.
Figure 5:
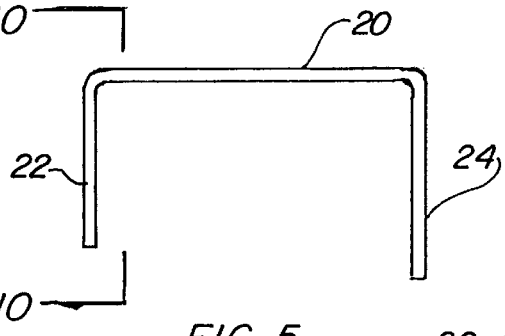
FIG. 5 is a side view of the inverted channel-shaped body completely removed from the invention for clarity.
Figure 6:
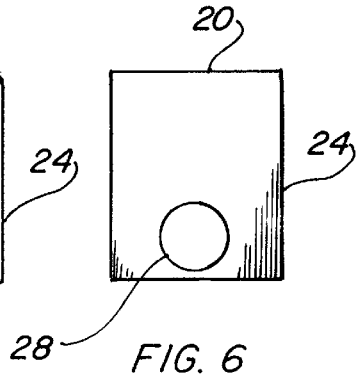
FIG. 6 is a right end view of the inverted channel-shaped body completely removed from the invention for clarity.

The best mode for carrying out the curb valve replacement and installation tool is presented in terms of a preferred embodiment. This preferred embodiment of the tool is shown in FIGS. 1 through 14 and is comprised of an inverted channel-shaped body 20 having a first leg 22 on one side and a second leg 24 on the other side, with both legs 22,24 downward depending as shown in FIGS. 1–6. The first leg 22 contains a clearance notch 26, and the second leg an alignment hole 28 as depicted in FIGS. 4 and 6. The channel-shaped body 20 is preferably formed from a metal plate that has been sheared and pierced in the flat and then bent by forming into the channel shape. While this material and method of fabrication is preferred, other types of construction are acceptable such as welded pieces, sheet metal with reinforcing gussets, iron or aluminum castings and so forth.

Figure 1:
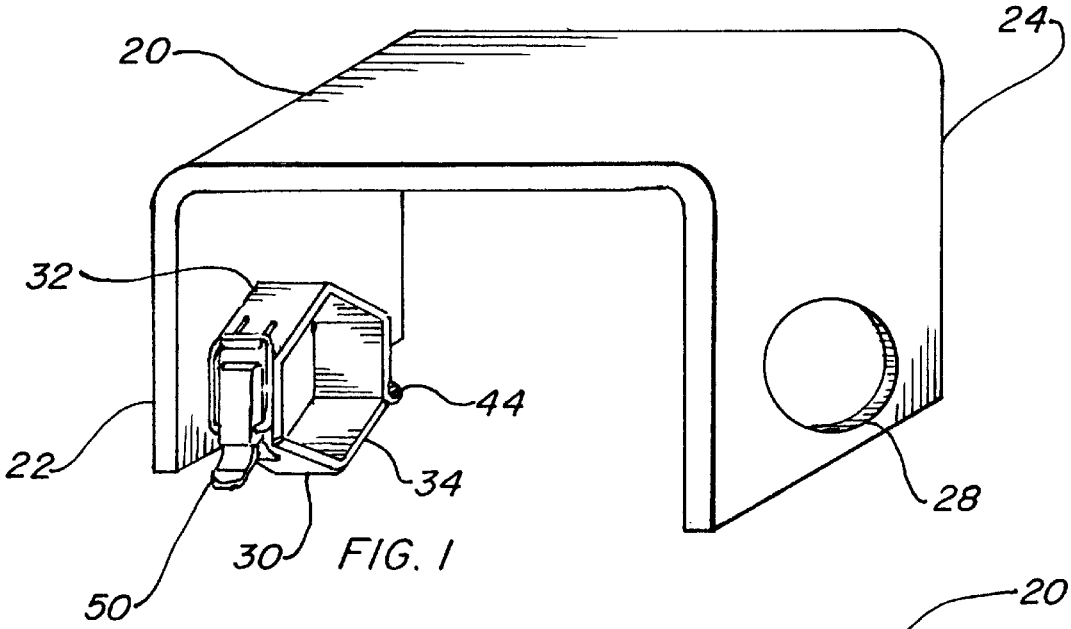
FIG. 1 is a partial isometric view of the preferred embodiment
Figure 8:
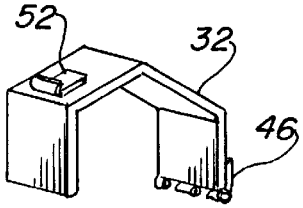
FIG. 8 is a partial isometric view of the elbow mounting bracket upper clasp completely removed from the invention for clarity.
Figure 9:
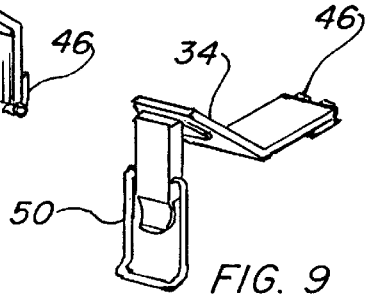
FIG. 9 is a partial isometric view of the elbow mounting bracket lower clasp completely removed from the invention for clarity.
Figure 10:
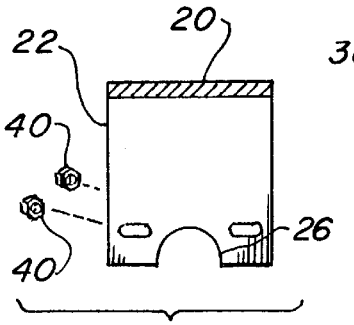
FIG. 10 is a partially exploded cross-sectional view taken along lines 10—10 of FIG. 5 illustrating the second attachment means for the elbow mounting bracket using screws and nuts.
Figure 11:
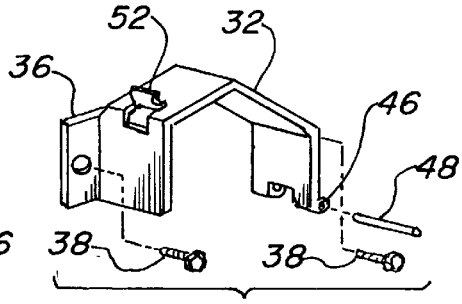
FIG. 11 is a partially exploded isometric view of the elbow mounting bracket upper clasp having integral hinge leafs and mounting flanges, illustrating the second attachment means for the elbow mounting bracket using screws and nuts, with the bracket completely removed from the invention for clarity.
Figure 12:
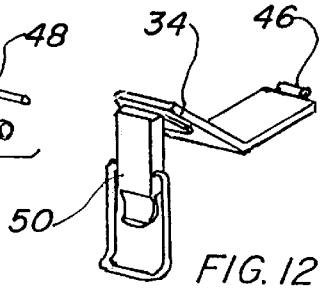
FIG. 12 is a partial isometric view of the elbow mounting bracket lower clasp having integral hinge leafs, completely removed from the invention for clarity.

A ball and socket elbow mounting bracket 30 is permanently affixed adjacent the first leg clearance notch 26, on the inner side, as illustrated in FIGS. 4 and 10. The mounting bracket 30 is fabricated in two separate pieces, as shown in FIGS. 7–9, 11 and 12, which consist of an upper clasp 32 and a lower clasp 34 with both protruding outward toward the alignment hole 28. The elbow mounting bracket 30 is affixed to the first leg 22 of the body 20 preferably by welding as depicted in FIGS. 1–3, however an alternate method is illustrated in FIGS. 11 and 12 wherein a pair of flanges 36 are formed integrally with the upper clasp 32 and are attached is by using common threaded fasteners such as screws 38 and nuts 40. Further, the flanges 36 may be attached by screws 38 into threaded holes in the body 20, riveted in place spot welded or any number of attachment methods well known in the art.

The mounting bracket upper clasp 32 and lower clasp 34 are hexagonal in shape to match the hexagonal flats on the horizontal end of the ball and socket elbow 42 that is attached to the city water main with copper pipe. Each of the two half's may be formed of sheet metal, as shown, or may be fabricated of a round tube machined with internal flats and then cut into two separate pieces. Additionally, other methods of construction for the bracket 30 may also be used in the invention without being beyond its concept.

Figure 7:
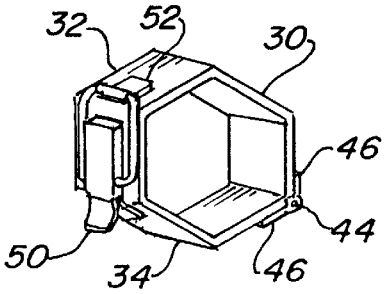
FIG. 7 is a partial isometric view of the assembled elbow mounting bracket completely removed from the invention for clarity.

The two separated hexagonal pieces must be hinged together to allow the tool to be connected to the ball and socket elbow 42. The connection is accomplished by the use of hinge means in the form of a continuous hinge 44, having a plurality of leafs 46, with the hinge 44 attached to each half of the bracket 30, as shown in FIGS. 7–9, using rivets, spot welding or the like. Another type of hinge is shown in FIGS. 11 and 12 where the leafs 46 of the hinge 44 are formed integrally in both the upper clasp 32 and the lower clasp 34 preferably with a plurality of leafs on the upper clasp 32 and at least one on the lower clasp 34. With either method a hinge pin 48 is utilized to attach the leafs. This pin 48 is shown removed in the partial exploded view of FIG. 11.

The latch means, by preference, consists of a draw pull latch 50, that is attached to the bracket lower clasp 34 and interfacing with a latch strike 52 fastened to the upper clasp 32 such that when the tool is positioned upon the hexagonal flats of the ball and socket elbow 42 and the bracket lower clasp 34 is pivoted into contact with the upper clasp 32 the tool is locked in place with the latch 50 grasping the strike 52. This arrangement permits an opened replacement curb valve 54, that has been connected to a pipe nipple 56 and loosely disposed within the alignment hole 28 to be manually threaded into the existing ball and socket elbow 42 while water is flowing under pressure from the water main. It should be noted that the strike 52 may be attached to the upper clasp 32 by conventional means such as spot welding, rivets or threaded fasteners as shown in FIGS. 7 and 8, or may be formed integrally of the parent sheet metal of the upper clasp 32 as illustrated best in FIG. 11. While a draw pull latch is illustrated and described, other fasteners, such as a toggle or grip latch may also be used with equal ease.

Figure 13:
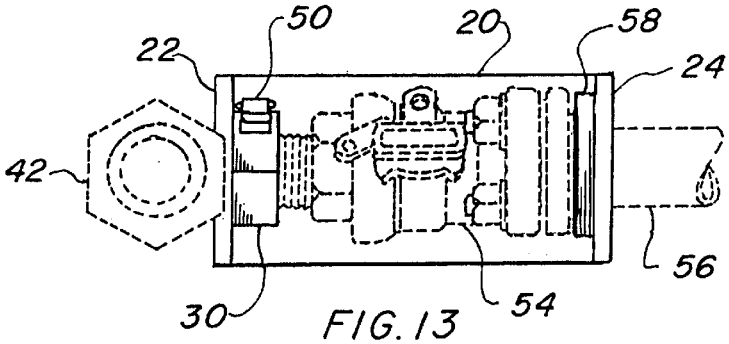
FIG. 13 is a bottom view of the installation tool clamped onto a ball and socket elbow with a replacement curb valve held in place by a pipe nipple with the elbow and valve shown with broken lines also a spacer to make the tool universal to fit shorter valves.
Figure 14:
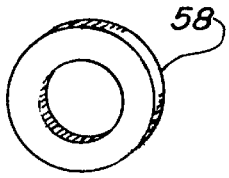
FIG. 14 is a partial isometric view of the spacer completely removed from the invention for clarity.

It may also be possible that the curb valve 54 or ball and socket elbow 42 may not all have the same length, especially when made by different manufacturers, therefore a spacer 58 may be added on the inner surface of the body second leg 24, thus surrounding the alignment hole 28 to compensate for the short valves and elbows, as illustrated in FIG. 13.

In use, the tool is required only when a residential or industrial curb valve 54 becomes inoperative as a result of being frozen in the open position or the handle or other parts of the valve being broken thereby rendering the valve useless even if the valve remains in the open position requiring replacement while under water pressure. The steps required for replacing a defective curb valve correspond with the drawings in FIGS. 2 and 3 and are as follows:

1. Loosen the defective curb valve cone nut located underneath.

2. Apply heat to the sides and upper portion of the defective curb valve to free the conical moveable element from the seat.

3. Rotate the cone nut in the defective valve with a wrench in a clockwise direction until the valve shut-off bar is perpendicular to the water line indicating that the valve is closed.

4. Tap the shut-off section of the defective valve to stop any sweating of the valve CAUTION KEEP ALL BODY PARTS AWAY FROM THE VALVE IN THE EVENT THE SHUT-OFF SECTION BLOWS UPWARD 5. Remove the water meter, 6. Plug the property water pipe or if the outlet of the curb valve is operable turn off to prevent debris and water from entering the property pipe.

7. Prepare the replacement curb valve 54 by opening and closing a few times to loosen then remove handle. While holding the replacement valve 54 on the backside of the tool body 20 as shown in FIGS. 2 and 3 (larger half of the curb valve facing the bracket 30), screw in a nipple 56 into the curb valve 54 through the alignment hole 28 as shown in FIGS. 1 and 6.

8. Open the defective curb valve, repeating the above steps in reverse order and remove the valve.

9. Place a U-bolt between the locking holes of the valve to prevent valve closure by the flowing water.

10. Install the tool with the replacement valve 54 in place as shown in FIG. 3 with the wrench shut-off positioned at 3 o'clock. Slide the notch leg 26 in back of the ball and socket elbow 42 hexagonal flats at a 3–5 degree angle. The replacement valve 54 is then held against the male threaded portion of the ball and socket elbow 42.

11. Lock the lower clasp 34 to the upper clasp 32 around the hexagonal flats of the ball and socket elbow 42 by slipping the draw pull latch 50 over the latch strike 52.

12. Screw in the replacement valve 54 into the internal threads of the ball and socket elbow 42 sufficiently to hold the valve in place without the tool and shut-off the valve.

13. Hold the body of the replacement valve 54 with a wrench and remove the nipple 56.

14. Remove the tool by unlocking the latch 50 and finish by tightening the valve in place.

15. Install the water meter and turn on the replacement curb valve 54.

While the invention has been described in complete detail and pictorially shown in the accompanying drawings, it is not to be limited to such details, since many changes and modifications may be made in the invention without departing from the spirit and scope thereof. Hence, it is described to cover any and all modifications and forms, which may come within the language and scope of the appended claims.

I claim:

1. An installation tool for replacing inoperable residential city water service curb valves comprising:

a) an inverted channel-shaped body with a downward depending first leg having a clearance notch therein and a downward depending second leg having an alignment hole therein, b) a ball and socket elbow mounting bracket having an upper clasp and a lower clasp with the upper clasp permanently affixed adjacent the first leg clearance notch, protruding outward toward the alignment hole, c) hinge means on said mounting bracket, pivotally connecting the bracket upper clasp to the bracket lower clasp, and d) latch means attached to the bracket lower clasp interfacing with the bracket upper clasp such that when the tool is positioned upon hexagonal flats of a ball and socket elbow and the bracket lower clasp is pivoted into contact with the upper clasp the tool is locked in place with the latch means, thus permitting an opened replacement curb valve that has been connected to a pipe nipple loosely disposed within the alignment hole to be manually threaded into an existing ball and socket elbow while water is flowing under pressure from a water main.

2. The installation tool for replacing inoperable residential city water service curb valves as recited in claim 1 wherein said body further comprising a metal plate pierced and formed into the channel shape.

3. The installation tool for replacing inoperable residential city water service curb valves as recited in claim 1 wherein said elbow mounting bracket upper clasp is affixed to the body first leg with a fillet weld.

4. The installation tool for replacing inoperable residential city water service curb valves as recited in claim 1 wherein said elbow mounting bracket upper clasp is affixed to the body first leg with a plurality of threaded fasteners.

5. The installation tool for replacing inoperable residential city water service curb valves as recited in claim 1 wherein said ball and socket elbow mounting bracket upper and lower clasps are formed of sheet metal in a hexagonal shape.

6. The installation tool for replacing inoperable residential city water service curb valves as recited in claim 1 wherein said upper clasp further comprises a plurality of hinge leafs.

7. The installation tool for replacing inoperable residential city water service curb valves as recited in claim 6 wherein said hinge leafs are formed integrally with said upper clasp.

8. The installation tool for replacing inoperable residential city water service curb valves as recited in claim 1 wherein said lower clasp further comprises at least one hinge leaf.

9. The installation tool for replacing inoperable residential city water service curb valves as recited in claim 8 wherein said hinge leaf is formed integrally with said lower clasp.

10. The installation tool for replacing inoperable residential city water service curb valves as recited in claim 1 wherein said hinge means further comprises a hinge pin connecting said bracket upper clasp to said bracket lower clasp.

11. The installation tool for replacing inoperable residential city water service curb valves as recited in claim 1 wherein said latch means further comprises a draw pull latch with a strike.

12. The installation tool for replacing inoperable residential city water service curb valves as recited in claim 11 wherein said draw pull latch is attached to said bracket lower clasp.

13. The installation tool for replacing inoperable residential city water service curb valves as recited in claim 11 wherein said bracket upper clasp further comprises said strike formed integrally with the bracket.

14. The installation tool for replacing inoperable residential city water service curb valves as recited in claim 1 further comprises a spacer disposed on an inside surface of the body second leg surrounding the alignment hole to compensate for short valves and elbows.

15. An installation tool for replacing inoperable residential city water service curb valves comprising:

a) Body with a downward depending first leg and a downward depending second leg having an alignment hole therein, b) service elbow mounting bracket having an upper clasp and a lower clasp with the upper clasp permanently affixed upon the first leg, protruding toward the alignment hole, c) hinge means upon both the upper and lower clasps, pivotally attaching the bracket upper clasp to the bracket lower clasp, and d) Latch means attached to the bracket upper clasp and bracket lower clasp such that when the tool is positioned upon hexagonal flats of a ball and socket elbow and the bracket lower clasp is pivoted into contact with the upper clasp the tool is locked in place with the latch means, thus permitting an opened replacement curb valve that has been connected to a pipe nipple loosely disposed within the alignment hole to be manually threaded into an existing ball and socket elbow while water is flowing under pressure from a water main.

16. An installation tool for replacing inoperable residential city water service curb valves comprising:

a) a body with a downward depending first leg and a downward depending second leg having an alignment hole therein, b) An elbow mounting means for grasping a ball and socket elbow, and d) Latch means attached to the elbow mounting means such that when the tool is positioned upon hexagonal flats of a ball and socket elbow, the tool is locked in place with the latch means, thus permitting an opened replacement curb valve that has been connected to a pipe nipple loosely disposed within the alignment hole to be manually threaded into an existing ball and socket elbow while water is flowing under pressure from a water main.

* * * * *